US008045736B2

(12) United States Patent
Shibata et al.

(10) Patent No.: US 8,045,736 B2
(45) Date of Patent: Oct. 25, 2011

(54) SOUND FIELD REPRODUCTION SYSTEM

(75) Inventors: Kiyosei Shibata, Kobe (JP); Masanobu Maeda, Kobe (JP)

(73) Assignee: Fujitsu Ten Limited, Hyogo (JP)

( * ) Notice: Subject to any disclaimer, the term of this patent is extended or adjusted under 35 U.S.C. 154(b) by 998 days.

(21) Appl. No.: 11/948,972

(22) Filed: Nov. 30, 2007

(65) Prior Publication Data

US 2008/0130922 A1 Jun. 5, 2008

(30) Foreign Application Priority Data

Dec. 1, 2006 (JP) ..... 2006-325479

(51) Int. Cl.
*H04R 5/02* (2006.01)
*H04S 1/00* (2006.01)

(52) U.S. Cl. ..... 381/302

(58) Field of Classification Search ..... 381/1, 86, 381/97, 388, 333, 302, 389, 300, 303, 304, 381/301, 305, 306, 307, 332, 386, 387, 71.4, 381/71.2, 71.6, 308, 101, 71.8, 17, 27, 89; 455/569.2; 295/250.1

See application file for complete search history.

(56) References Cited

U.S. PATENT DOCUMENTS

| | | | | |
|---|---|---|---|---|
| 4,490,842 | A | 12/1984 | Watanabe | |
| 7,092,531 | B2 * | 8/2006 | Enya et al. | 381/86 |
| 7,164,773 | B2 * | 1/2007 | Fabry | 381/86 |
| 7,684,577 | B2 * | 3/2010 | Arai et al. | 381/302 |
| 2002/0076059 | A1 * | 6/2002 | Joynes | 381/71.6 |
| 2005/0135636 | A1 * | 6/2005 | Putti et al. | 381/86 |
| 2008/0273713 | A1 * | 11/2008 | Hartung et al. | 381/86 |
| 2008/0292106 | A1 * | 11/2008 | Nakagaki | 381/1 |
| 2009/0074198 | A1 * | 3/2009 | Yoshida et al. | 381/71.4 |

FOREIGN PATENT DOCUMENTS

| | | |
|---|---|---|
| JP | S60-112182 | 7/1985 |
| JP | 61-028293 | 2/1986 |
| JP | 04-364700 | 12/1992 |
| JP | 5-199595 | 8/1993 |
| JP | 05-227586 | 9/1993 |
| JP | 05-308698 | 11/1993 |
| JP | 07-288885 | 10/1995 |
| JP | 2002-264732 | 9/2002 |

(Continued)

OTHER PUBLICATIONS

Japanese Office action drafted Nov. 27, 2008, for priority Japanese application 2006-325479, noting listed references in this IDS.

(Continued)

*Primary Examiner* — Dao Nguyen
*Assistant Examiner* — Tram H Nguyen
(74) *Attorney, Agent, or Firm* — Christie, Parker & Hale LLP

(57) ABSTRACT

The present invention is directed to providing a sound field reproduction system that can enhance the sound separation between the front and rear seats or left and right seats of a vehicle. The sound field reproduction system includes a control unit for creating a first sound signal and a second sound signal from one or a plurality of sources, a narrow-directional speaker mounted on the front seat side of the vehicle, a speaker mounted on the rear seat side of the vehicle, and a signal processing unit for driving the narrow-directional speaker based on the first sound signal that has been processed according to frequency range, and for driving the speaker based on the second sound signal.

22 Claims, 16 Drawing Sheets

FOREIGN PATENT DOCUMENTS

| | | | |
|---|---|---|---|
| JP | 2004-363696 | | 12/2004 |
| JP | 2005-051660 | | 2/2005 |
| JP | 2005-159913 | | 6/2005 |
| JP | 2005-217807 | | 8/2005 |
| JP | 2005-286903 | | 10/2005 |
| JP | 2006-197551 | | 7/2006 |
| WO | WO 2004/107812 | A1 | 12/2004 |
| WO | WO 2005/064986 | A1 | 7/2005 |
| WO | WO 2006/109389 | A1 | 10/2006 |

OTHER PUBLICATIONS

Japanese Office action drafted Feb. 20, 2009, for priority Japanese application 2006-325479, noting listed references in this IDS, namely JP 05-308698 and WO 2006/109389.

Patent Abstracts of Japan, Publication No. 05-199595; Date of Publication: Aug. 6, 1993; in the name of Toshihiko Date.

Patent Abstracts of Japan, Publication No. 07-288885; Date of Publication: Oct. 31, 1995; in the name of Koji Aoyanagi et al.

Patent Abstracts of Japan, Publication No. 2004-363696; Date of Publication: Dec. 24, 2004; in the name of Yusuke Konagai.

Patent Abstracts of Japan, Publication No. 2005-159913; Date of Publication: Jun. 16, 2005; in the name of Akira Sakamoto.

Patent Abstracts of Japan, Publication No. 2005-217807; Date of Publication: Aug. 11, 2005; in the name of Makoto Watanabe et al.

Chinese Office action dated Oct. 13, 2010 for corresponding Chinese application No. 200710196338.9, 9 pp.

* cited by examiner

BACKLIGHT
TFT SUBSTRATE
LIQUID CRYSTAL LAYER
100
101
102
103
104
105
106
107
108
R(L)
G(R)
B(L)
R(R)
G(L)
B(R)
(LEFT)
(RIGHT)
DETAILS
CHANGE THE DISPLAY
RETRIEVAL AGAIN
REGISTER THE POINT
WIDE AREA
ESTIMATED ARRIVAL
9
NEWS
8
(RIGHT) DRIVER SIDE
11
(LEFT) PASSENGER SIDE
10

GAIN ADJUSTING CIRCUIT
70
SECOND ARRAY SPEAKER
41
SPEAKER UNIT
45
46
47
48
SETTING 1-1
0db
0db
0db
0db
SETTING 1-2
-3db
+3db
-4db
+4db
SETTING 1-3
-3db
-3db
+2db
+2db

PHASE ADJUSTING CIRCUIT
71
SECOND ARRAY SPEAKER
41
SPEAKER UNIT
45
46
47
48
SETTING 2-1
0°
0°
0°
0°
SETTING 2-2
0°
0°
180°
0°
SETTING 2-3
0°
180°
0°
0°

DELAY AMOUNT ADJUSTING CIRCUIT
72
SECOND ARRAY SPEAKER
41
SPEAKER UNIT
45
46
47
48
SETTING 3-1
0ms
0ms
0ms
0ms
SETTING 3-2
5ms
0ms
0ms
5ms
SETTING 3-3
10ms
5ms
0ms
0ms

SOUND FIELD REPRODUCTION SYSTEM

This application is a new U.S. patent application that claims benefit of JP 2006-325479, filed on Dec. 1, 2006, the entire content of JP 2006-325479 is hereby incorporated by reference.

FIELD OF THE INVENTION

The present invention relates to a sound field reproduction system, and more specifically to a personal sound field reproduction system that allows a plurality of people sitting near each other to listen to different sound sources.

BACKGROUND OF THE INVENTION

It is known to provide an automotive audio system in which, in addition to four speakers being mounted in four door panels, speakers for the vehicle driver are mounted in the headrest of the driver seat so that only the driver can listen to route guidance and traffic congestion information from the navigation system, while allowing other vehicle occupants other than the driver to listen to music being played back on a CD player (refer, for example, to patent document 1).

However, since the sounds from the usual four speakers mounted in the four door panels can also be heard by the driver, there has been the problem that the sounds may become distracting to the driver when the driver is listening to route guidance and traffic congestion information from the navigation system, while on the other hand, sound leakage from the driver seat speakers may disturb the other occupants who are listening to music being played back on a CD player.

It is also known to provide an array speaker system that uses an array speaker which produces sound from a plurality of orderly arranged speaker units, and that controls the directivity of the sound to be output from each individual speaker unit of the array speaker (refer for example to patent document 2). In this system, control can be performed so that sounds from the different speaker units simultaneously arrive at a desired point in space by adjusting the amount of delay of a sound signal to be input to each individual speaker unit.

However, the above system has not been designed by taking into consideration the environment inside a vehicle, nor has it been a system designed for use in any specific frequency range of the sound output signal.

Patent document 1: Japanese Unexamined Patent Publication No. 2005-159913 (FIG. 2)

Patent document 2: Japanese Unexamined Patent Publication No. 2004-363696 (FIG. 7)

SUMMARY OF THE INVENTION

Accordingly, it is an object of the present invention to provide a sound field reproduction system that can solve the above problems.

It is another object of the present invention to provide a sound field reproduction system that can enhance the sound separation between the front and rear seats or left and right seats of a vehicle.

It is a further object of the present invention to provide a sound field reproduction system that allows the occupant of each seat inside a vehicle to listen to an independent sound source in a good condition.

A sound field reproduction system according to the present invention includes a control unit for creating a first sound signal and a second sound signal from one or a plurality of source, a narrow-directional speaker mounted in or near a front seat of a vehicle, a speaker mounted in or near a rear seat of the vehicle, and a signal processing unit for driving the narrow-directional speaker based on the first sound signal that has been processed according to frequency range, and for driving the speaker based on the second sound signal.

The sound field reproduction system according to the present invention includes a control unit for creating a first sound signal and a second sound signal from one or a plurality of sources, a first narrow-directional speaker mounted on a passenger side of a vehicle, a second narrow-directional speaker mounted on a driver side of the vehicle, and a signal processing unit for driving the first narrow-directional speaker based on the first sound signal that has been processed according to frequency range, and for driving the second narrow-directional speaker based on the second sound signal has been processed according to frequency range.

According to the sound field reproduction system of the present invention, the occupants of the front and rear seats of the vehicle can listen to different sound sources and/or music sources without the sound sources interfering with each other.

Further, according to the sound field reproduction system of the present invention, the sound and/or music corresponding to the first display image and the second display image simultaneously displayed on the display unit can be enjoyed at the passenger seat and the driver seat without the sound sources interfering with each other.

DETAILED DESCRIPTION OF THE PREFERRED EMBODIMENTS

A sound field reproduction system according to the present invention will be described below with reference to the drawings. However, it should be noted that the scope of the present invention is not limited by the specific embodiments described herein, but may be defined by the appended claims and their equivalents.

Figure 1:
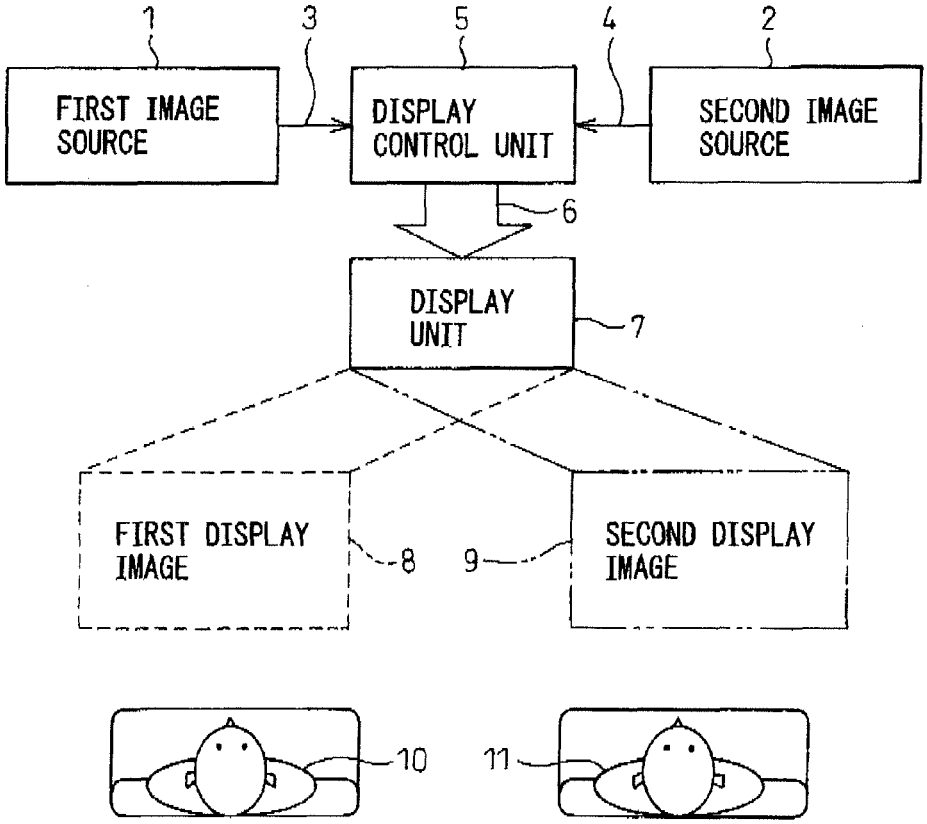
FIG. 1 is a conceptual diagram of a display device.

FIG. 1 is a conceptual diagram of a display device. In the figure, reference numeral 1 is a first image source, 2 is a second image source, 3 is first image data from the first image source, 4 is second image data from the second image source, 5 is a display control unit, 6 is display data, 7 is a display unit (constructed, for example, from a liquid crystal panel or the like), 8 is a first display image based on first image source 1, 9 is a second display image based on second image source 2, 10 is an observer (user) located to the left relative to the display unit 7, and 11 is an observer (user) located to the right relative to the display unit 7.

The diagram of FIG. 1 conceptually shows that first display image 8 and second display image 9 can in effect be displayed simultaneously on display unit 7 in such a manner that observers 10 and 11 can view first and second display images 8 and 9, respectively, and independently of each other, depending on the positions of the observers 10 and 11 relative to the display unit 7, or in other words, depending on their angles of viewing relative to the display unit 7, and also that the respective display images 8 and 9 can each be viewed over the entire display screen of the display unit 7. In FIG. 1, the first image source 1 is, for example, a movie image from a DVD player or a television image from a television receiver, and the second image source 2 is, for example, a map or a route guidance image from a car navigation system; the first and second image data 3 and 4 representing the respective images are supplied to the display control unit 5 where the display data are processed so that the respective images can in effect be displayed simultaneously on the display unit 7.

The display unit 7 to which the display data 6 is supplied from the display control unit 5 is constructed from a liquid crystal panel or the like provided with a parallax barrier as will be described later. Half of the total number of pixels as counted horizontally across the display unit 7 is used for displaying the first display image 8 based on the first image source 1, and the remaining half is used for displaying the second display image 9 based on the second image source 2. Only the pixels corresponding to the first display image 8 are visible to the observer 10 located to the left relative to the display unit 7, and the second display image 9 is substantially invisible as it is blocked by the parallax barrier formed on the surface of the display unit 7. On the other hand, only the pixels corresponding to the second display image 9 are visible to the observer 11 located to the right relative to the display unit 7, and the first display image 8 is substantially invisible as it is blocked by the parallax barrier.

With the above structure, different information or different kinds of content can be presented for viewing on the same screen to the left and right users, respectively. Of course, if the first and second image sources are the same, the same image can be presented for viewing to both the left and right users, as in a conventional system.

Figure 2:
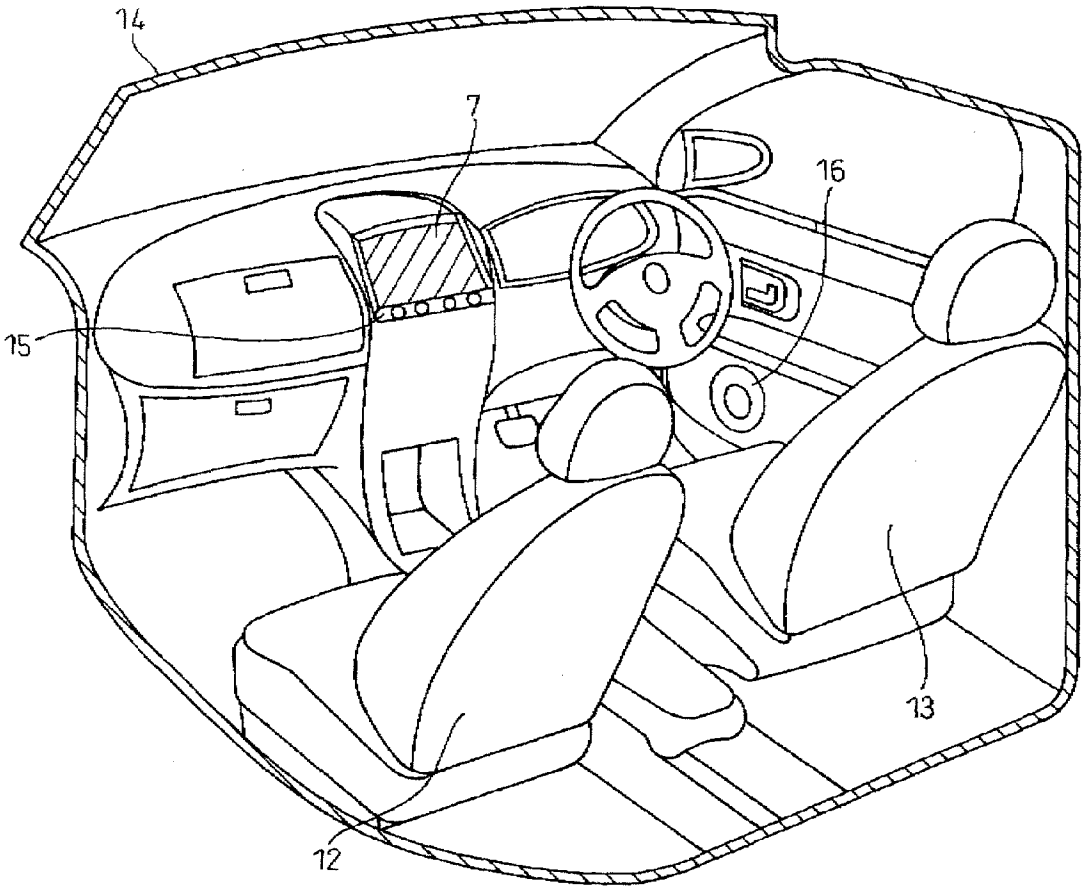
FIG. 2 is a perspective view showing a mounting example of the display device.

FIG. 2 is a perspective view showing an example of how such a multi-view display device is mounted in a vehicle. In the figure, reference numeral 12 is a passenger seat, 13 is a driver seat, 14 is a windshield, 15 is an operating unit, and 16 is a speaker.

The display unit 7 of the multi-view display device of FIG. 1 is mounted in the dashboard portion located substantially centered between the driver seat 13 and the passenger seat 12, for example, as shown in FIG. 2. Various operations to the multi-view display device are performed by operating a touch panel (not shown) integrally formed on the surface of the display unit 7 or by operating the operating unit 15 or an infrared or wireless remote controller (not shown). The speaker 16, which is mounted in each door of the vehicle, outputs a sound accompanying the displayed image or an alarm sound or the like.

The observer 11 in FIG. 1 is seated in the driver seat 13, while the observer 10 is seated in the passenger seat 12. The image that can be viewed from a first viewing direction relative to the display unit 7 (i.e., from the driver side) is, for example, an image such as a map from a car navigation system, and the image that can in effect be viewed at the same time from a second viewing direction (i.e., from the passenger side) is, for example, a television image or a DVD movie image. Accordingly, while the driver in the driver seat 13 is being assisted in navigation by the car navigation system, the occupant of the passenger seat 12 can watch television or a DVD movie. Furthermore, since each image is displayed over the entire display area of, for example, a 7-inch screen, the screen need not be split into smaller areas for displaying the respective images as in a conventional multi-window type display. In other words, information or content suitable for the driver and the passenger, respectively, can be presented for viewing independently of each other and simultaneously on the same screen as if a dedicated display unit were provided for each occupant.

Figure 3:
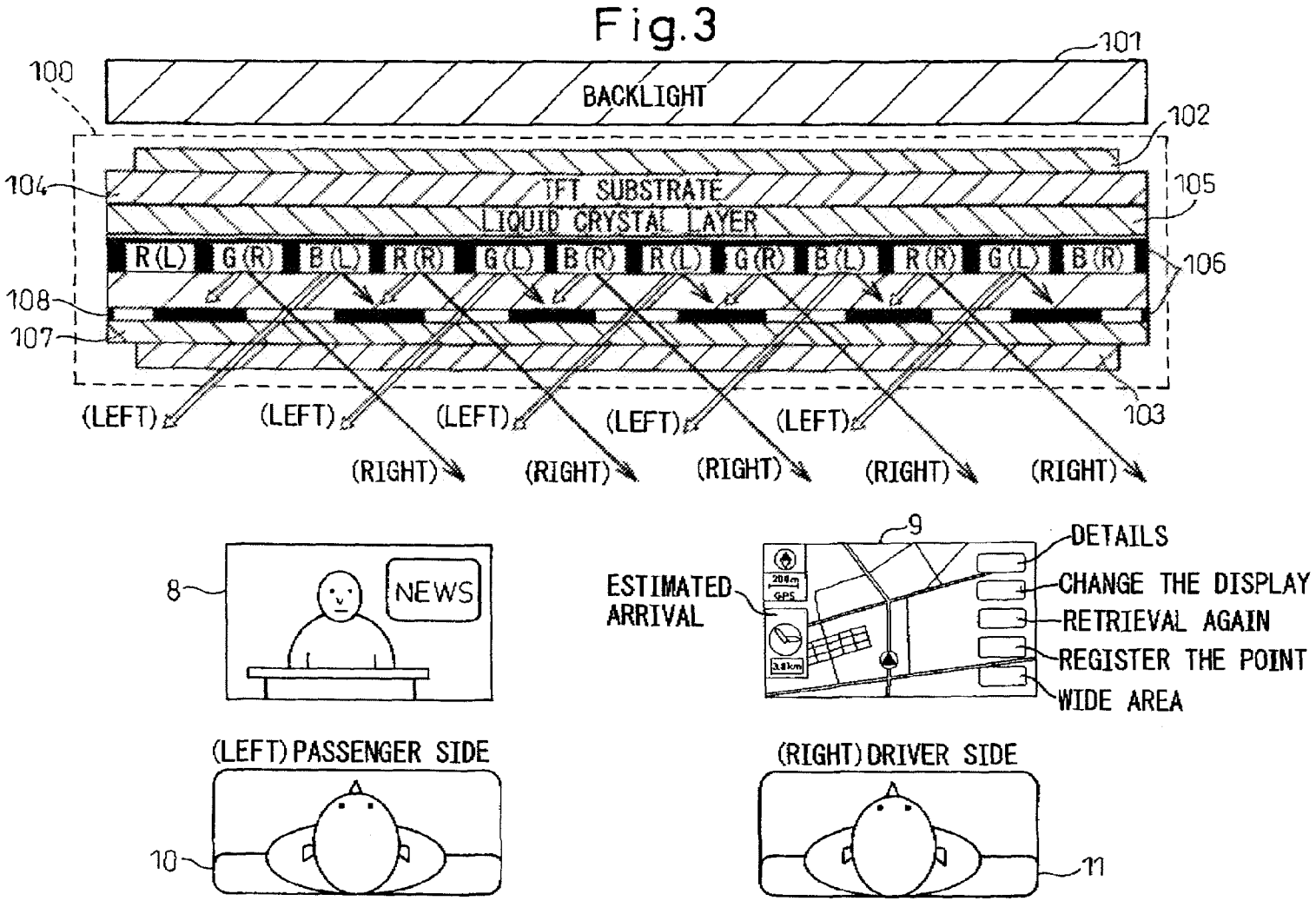
FIG. 3 is a diagram schematically showing the cross-sectional structure of a display unit.

FIG. 3 is a diagram schematically showing the cross-sectional structure of the display unit 7. In the figure, reference numeral 100 is a liquid crystal panel, 101 is a backlight, 102 is a polarizer disposed on the backlight side of the liquid crystal panel, 103 is a polarizer disposed on the light-emerging front side of the liquid crystal panel, 104 is a TFT (Thin Film Transistor) substrate, 105 is a liquid crystal layer, 106 is a color filter substrate, 107 is a glass substrate, and 108 is a parallax barrier. The liquid crystal panel 100 is constructed by sandwiching the liquid crystal layer 105 between the pair of substrates, i.e., the TFT substrate 104 and the opposing color filter substrate 106, and further sandwiching the pair of substrates and the parallax barrier 108 and glass substrate 107 disposed on the light-emerging front side thereof between the two polarizers 102 and 103. The liquid crystal panel 100 is spaced a certain distance away from the backlight 101. Further, the liquid crystal panel 100 contains pixels of RGB colors (three primary colors).

The pixels in the liquid crystal panel 100 are controlled for display by being divided between the pixels for the left-view (passenger-side) display and the pixels for the right-view (driver-side) display. The pixels for the left-view (passenger-side) display are visible from the left side (the passenger side), but are not visible from the right side (the driver side) because the display is blocked by the parallax barrier 108. Likewise, the pixels for the right-view (driver-side) display are visible from the right side (the driver side), but are not visible from the left side (the passenger side) because the display is blocked by the parallax barrier 108. In this way, different images can be presented, for example, to the driver 11 and the passenger 10, respectively. In other words, navigation map information 9 can be presented for viewing to the driver 11, and at the same time, a DVD movie 8 or the like can be presented for viewing to the passenger 10. It is also possible to present different images in three or more directions by modifying the structure of the parallax barrier 108 and the arrangement of the pixels in the liquid crystal panel. Further, the viewing angle may be made variable by constructing the parallax barrier from a liquid crystal shutter or the like that can be electrically driven.

Figure 4:
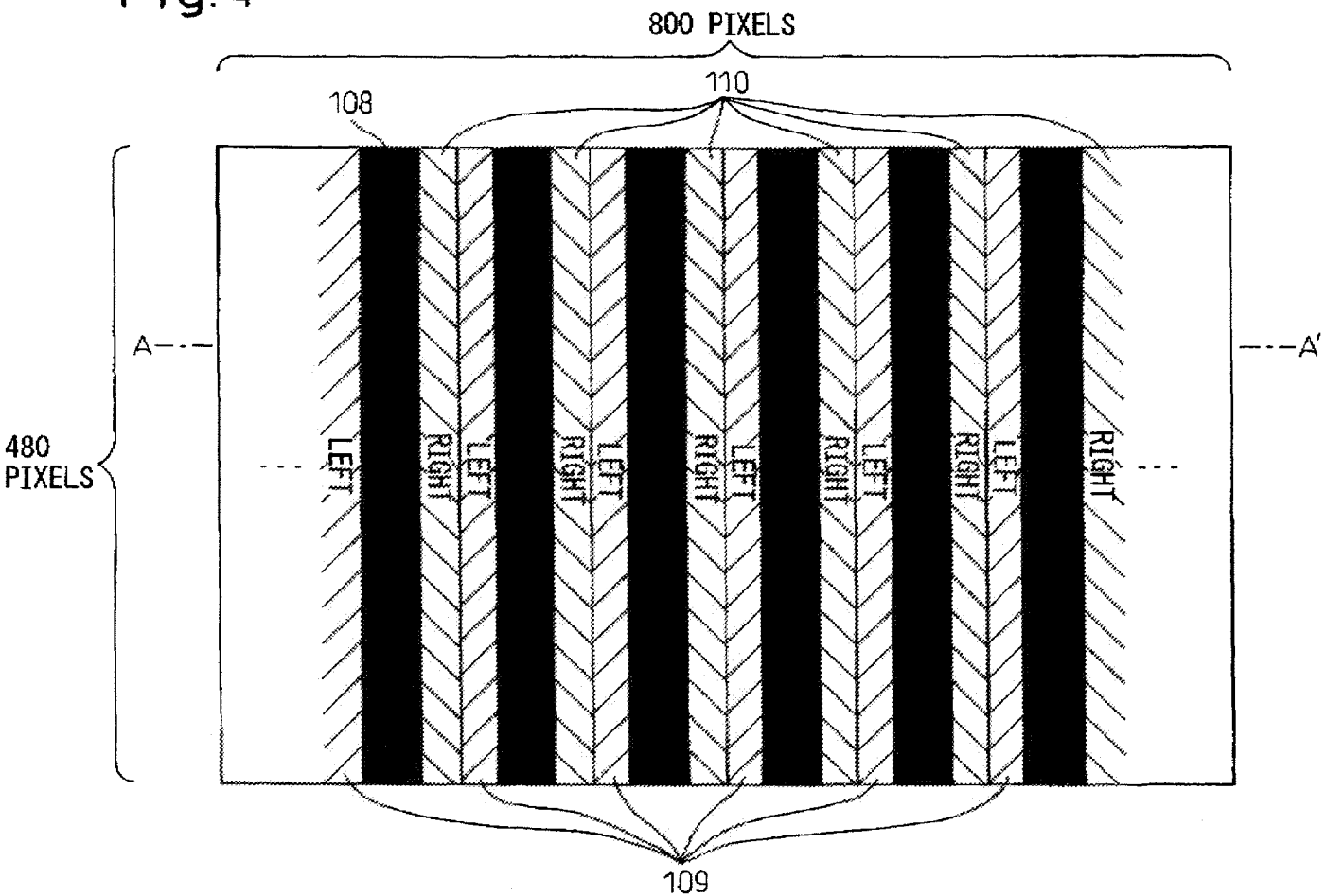
FIG. 4 is a diagram schematically showing the structure of a display panel as viewed from the front side thereof.

FIG. 4 is a diagram schematically showing the structure of the display panel as viewed from the front side thereof, and FIG. 3 is a cross-sectional view taken along A-A' in FIG. 4. In the figure, reference numeral 109 indicates the pixels for the left-view (passenger-side) display, and 110 the pixels for the right-view (driver-side) display. FIGS. 3 and 4 show a portion of the liquid crystal panel 100 having, for example, 800 pixels horizontally and 480 pixels vertically. The pixels 109 for the left-view (passenger-side) display and the pixels 110 for the right-view (driver-side) display are respectively grouped as vertical columns of pixels and are arranged in alternating fashion. The parallax barriers are arranged side by side along the horizontal direction, one spaced a certain distance apart from another, and each extending vertically with a uniform thickness. Accordingly, when the display panel is viewed from the left side, the pixels 110 for the right-view display are hidden behind the parallax barriers 108, and only the pixels 109 for the left-view display are visible. Likewise, when it is viewed from the right side, the pixels 109 for the left-view display are hidden behind the parallax barriers 108, and only the pixels 110 for the right-view display are visible. On the other hand, when the display panel is viewed straight on, the pixels 109 for the left-view display and the pixels 110 for the right-view display are both visible, so that the left-view display image and the right-view display image are seen with one substantially overlapping the other. The pixels 109 for the left-view display and the pixels 110 for the right-view display, arranged in alternating fashion in FIG. 4, have RGB colors as shown in FIG. 3; here, each column of pixels may consist of pixels of the same color, such as R-color pixels, G-color pixels, or B-color pixels, or of pixels of different RGB colors.

Figure 5:
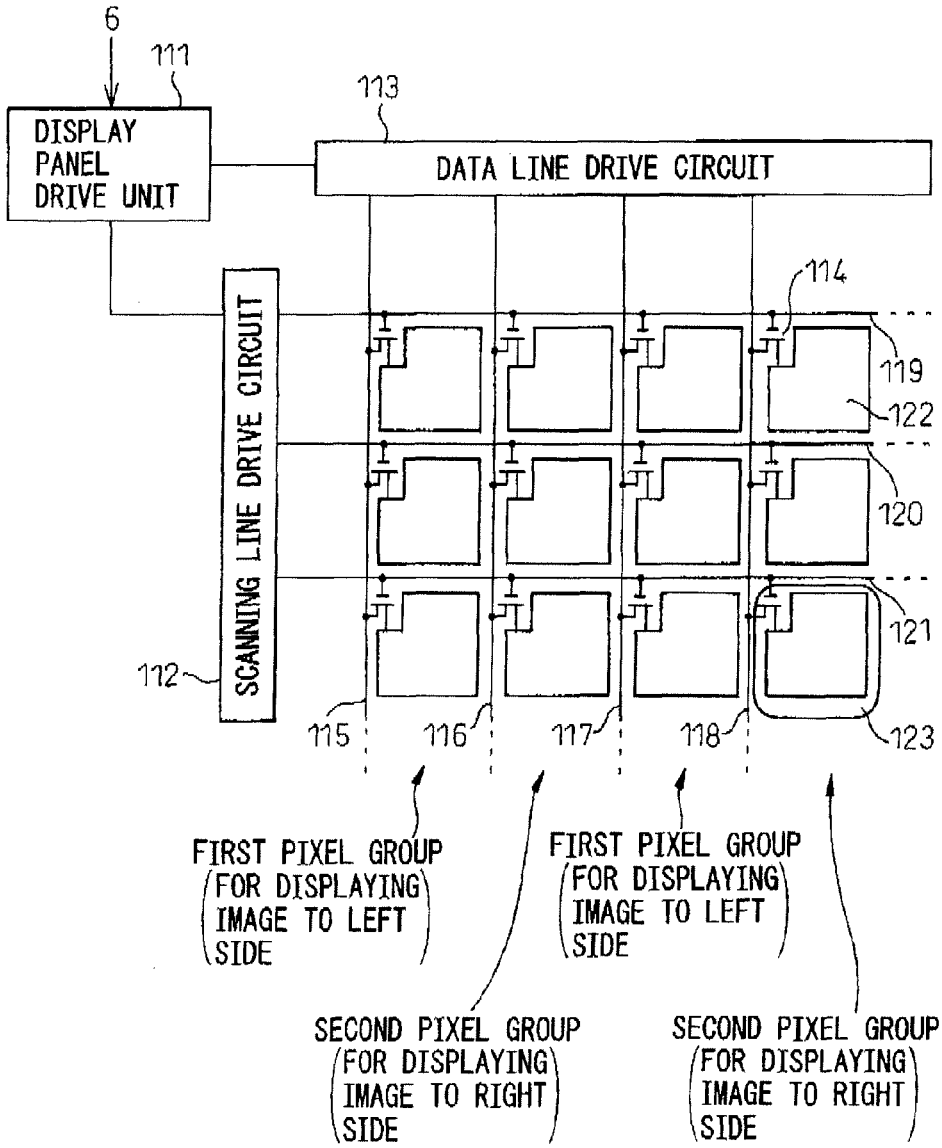
FIG. 5 is a circuit diagram schematically showing a TFT substrate.

FIG. 5 is a circuit diagram schematically showing the TFT substrate 104. Reference numeral 111 is a display panel drive unit, 112 is a scanning line drive circuit, 113 is a data line drive circuit, 114 is a TFT device, 115 to 118 are data lines, 119 to 121 are scanning lines, 122 is a pixel electrode, and 123 is a sub-pixel. As shown in FIG. 5, the sub-pixel is formed in a region enclosed by corresponding ones of the data lines 115 to 118 and corresponding ones of the scanning lines 119 to 121, and a plurality of such sub-pixels are formed. The pixel electrode 122 for applying a voltage to the liquid crystal layer 105 and the TFT device 114 for controlling the switching thereof are formed within each sub-pixel. The display panel drive unit 111 controls the driving timing of the scanning line drive circuit 112 and the data line drive circuit 113. The scanning line drive circuit 112 selects the respective TFT devices 114 by scanning, while the data line drive circuit 113 controls the voltage applied to each pixel electrode 122.

The plurality of sub-pixels are divided into two groups, the first image data group for displaying the first image and the second image data group for displaying the second image, and the respective images are displayed by applying the first pixel data (for the left-view image display), for example, to the data lines 115 and 117 and the second pixel data (for the right-view image display) to the data lines 116 and 118, based on the combined data of the first and second image data or on the independent first and second image data.

Figure 6:
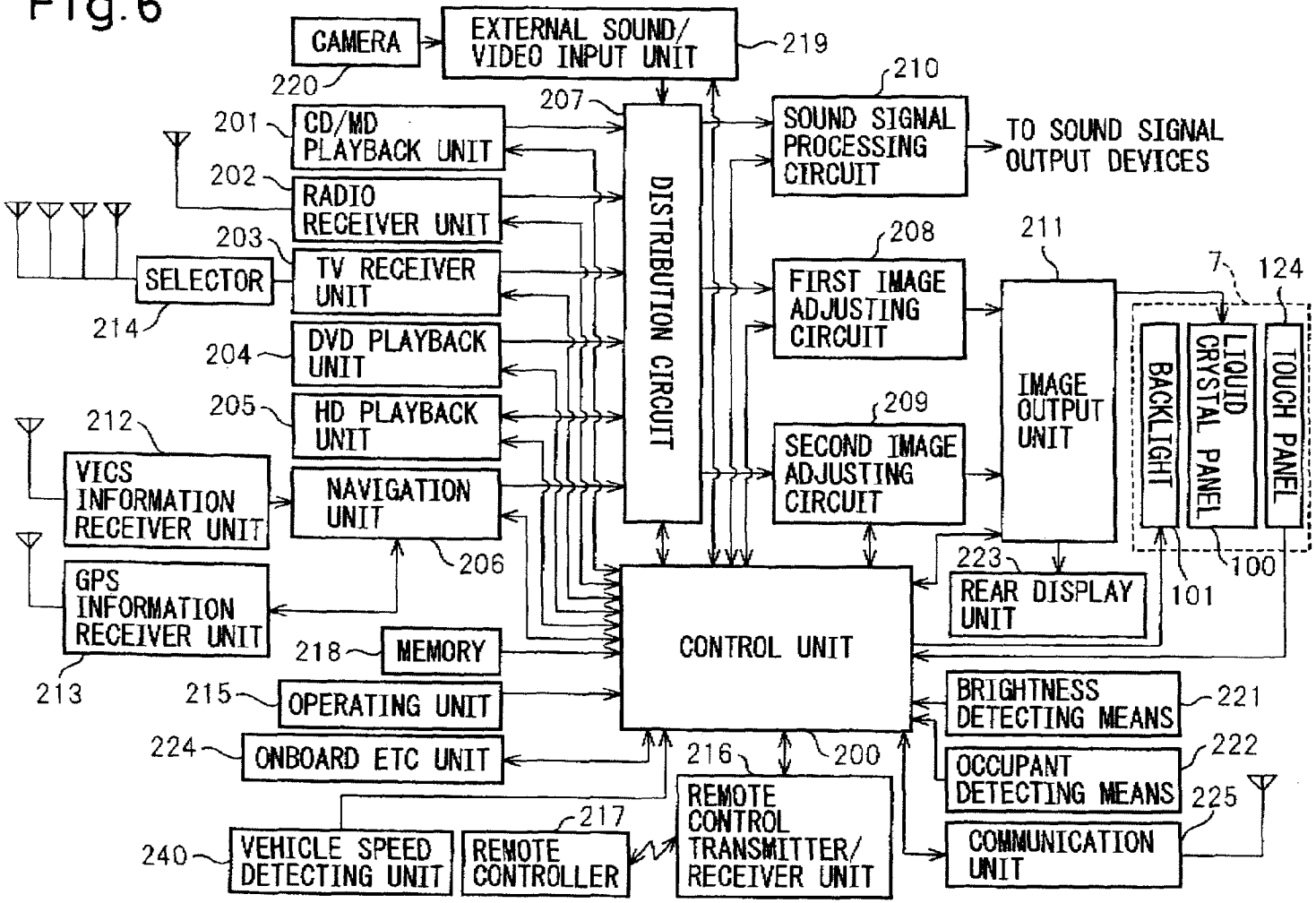
FIG. 6 is a block diagram schematically showing the configuration of an entire system.

FIG. 6 is a block diagram schematically showing the configuration of the entire system as applied to a so-called audio visual navigation combination system. In the figure, reference numeral 124 is a touch panel, 200 is a control unit, 201 is a CD/MD playback unit, 202 is a radio receiver unit, 203 is a TV receiver unit, 204 is a DVD playback unit, 205 is a HD (Hard Disk) playback unit, 206 is a navigation unit, 207 is a distribution circuit, 208 is a first image adjusting circuit, 209 is a second image adjusting circuit, 210 is a sound signal processing circuit, 211 is an image output unit, 212 is a VICS information receiver unit, 213 is a GPS information receiver unit, 214 is a selector, 215 is an operating unit, 216 is a remote control transmitter/receiver unit, 217 is a remote controller, 218 is a memory, 219 is an external sound/video input unit, 220 is a camera, 221 is a brightness detecting means, 222 is an occupant detecting means, 223 is a rear display unit, 224 is an onboard ETC unit, 225 is a communication unit, and 240 is a vehicle speed detecting unit.

The touch panel 124, the liquid crystal panel 100, and the backlight 101 together constitute the display unit 7. As earlier described, the liquid crystal panel 100 of the display unit 7 can, in effect, simultaneously display the image to be viewed from the first viewing direction, i.e., from the driver side, and the image to be viewed from the second viewing direction, i.e., from the passenger side. For the display unit 7, a flat panel display other than the liquid crystal panel may be used, examples including an organic EL display panel, a plasma display panel, and a cold-cathode flat panel display.

Under instructions from the control unit 200, sound and video from various sources (CD/MD playback unit 201, radio receiver unit 202, TV receiver unit 203, DVD playback unit 204, HD playback unit 205, and navigation unit 206) are distributed to the appropriate circuits via the distribution circuit 207 which distributes the image source designated for the left view to the first image adjusting circuit 208 and the image source designated for the right view to the second image adjusting circuit 209; more specifically, video is distributed to the first and second image adjusting circuits 208 and 209, and sound is distributed to the sound signal processing circuit 210. The first and second image adjusting circuits 208 and 209 adjust brightness, color tone, contrast, etc., and the image output unit 211 outputs the thus adjusted images to the display unit 7 for display. The sound signal processing circuit 210 adjusts the distribution of the sound between the speakers, as well as the sound volume, tone, etc. and the thus adjusted sound is output from the various sound signal output devices to be described later.

Figure 7:
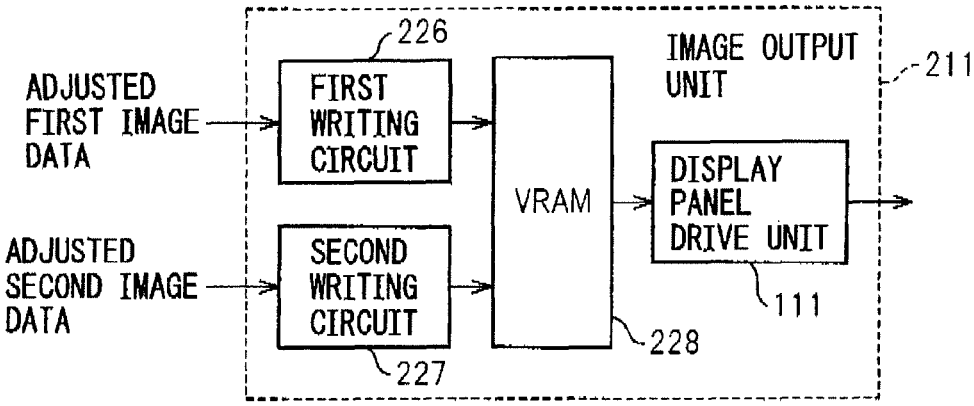
FIG. 7 is a block diagram schematically showing an image output unit 211.

FIG. 7 is a block diagram schematically showing the image output unit 211. In the figure, reference numeral 226 is a first writing circuit, 227 is a second writing circuit, and 228 is a VRAM (Video RAM).

The image output unit 211 comprises, for example, as shown in FIG. 7, the first writing circuit 226, the second writing circuit 227, the VRAM (Video RAM) 228, and the display panel drive unit 111. For example, the first writing circuit 226 receives the image data adjusted by the first image adjusting circuit 208 and writes the image data corresponding to the odd-numbered columns (that is, the image data for the first display image 8 in FIG. 1) into a designated area in the VRAM 228, while the second writing circuit 227 receives the image data adjusted by the second image adjusting circuit 209 and writes the image data corresponding to the even-numbered columns (that is, the image data for the second display image 9 in FIG. 1) into a designated area in the VRAM 228. The display panel drive unit 111 is a circuit for driving the liquid crystal panel 100, and drives the corresponding pixels in the liquid crystal panel 100 based on the image data (combined data of the first and second image data) held in the VRAM 228. Here, since the image data are written to the VRAM 228 so that multi-view display images can be generated from the combined data of the first and second image data, only one drive circuit suffices for the purpose, and its operation is the same as that of the drive circuit for the conventional liquid crystal display. As an alternative configuration, a first display panel drive circuit and a second display panel drive circuit may be provided which respectively drive the corresponding pixels in the liquid crystal panel 100 based on the respective image data, without having to combine the first and second image data.

To describe one example of the various sources shown in FIG. 6, when the HD playback unit 205 is selected, music data such as an MP3 file, image data such as a JPEG file, map data for navigation, etc., can be read out from the hard disk (HD), and a menu for selecting music titles or the readout image data can be displayed on the display unit 7.

The navigation unit 206 includes a map information storage unit for storing map information used for navigation, and can acquire information from the VICS information receiver unit 212 and GPS information receiver unit 213, create images for navigation, and display the images. The TV receiver unit 203 receives analog or digital TV broadcast waves via an antenna and via the selector 214.

Figure 8:
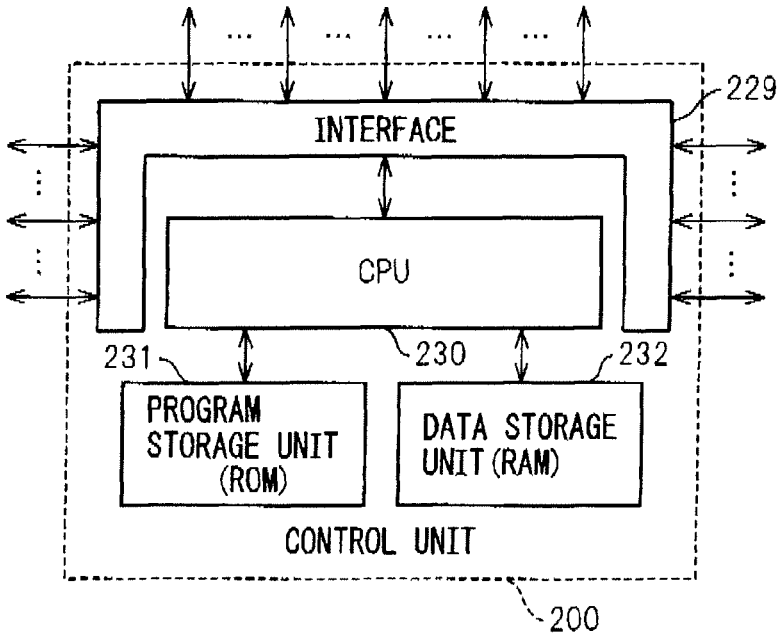
FIG. 8 is a block diagram schematically showing a control unit 200.

FIG. 8 is a block diagram schematically showing the control unit 200. In the figure, reference numeral 229 is an interface, 230 is a CPU, 213 is a storage unit, and 232 is a data storage unit.

The control unit 200 controls the distribution circuit 207 and the various sources so as to display two or one selected source. The control unit 200 also performs control so that an operation menu for controlling the various sources is displayed on the display unit 7. As shown in FIG. 8, the control unit 200 is constructed from a microprocessor or the like, and includes the CPU 230 which centrally controls the various parts and circuits in the display device via the interface 229. The CPU 230 includes the program storage unit 231 constructed from a ROM for storing various programs necessary for operating the display device, and the data storage unit 232 constructed from a RAM for storing various kinds of data. Here, the ROM and RAM may be internal or external to the CPU. The ROM may be an electrically alterable nonvolatile memory such as a flash memory.

Figure 10:
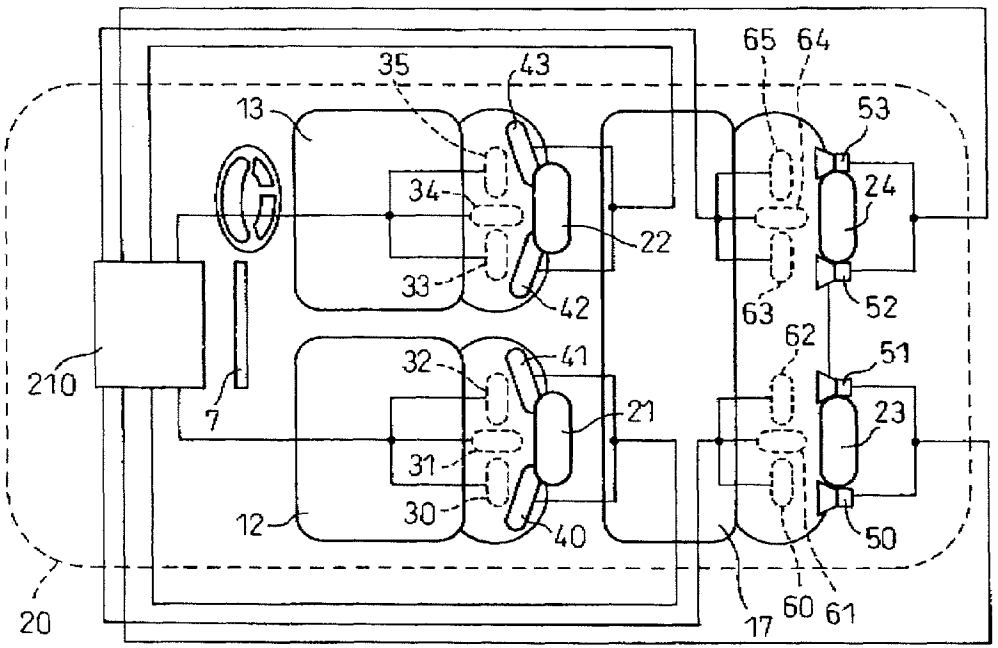
FIG. 10 is a diagram showing an example of how sound signal output devices are arranged inside a vehicle 1 equipped with a sound field reproduction system according to the present invention.

The user can control the various sources by operating the touch panel 124 formed on the surface of the display unit 7 or the switches provided around the periphery of the display unit 7, or by performing voice-activated input or selection operations on the operating unit 215. Input or selection operations may also be performed via the remote control transmitter/receiver unit 216 by using the remote controller 217. The control unit 200 controls the various sources and circuits in accordance with the operations performed on the touch panel 124 or the operating unit 215. The control unit 200 is also constructed so that the sound volumes, etc. of the front-seat vibrating devices 30 to 35, directional speakers 40 to 43, speakers 50 to 53, and rear-seat vibrating devices 60 to 65 mounted inside the vehicle, as shown in FIG. 10, can be controlled by using the touch panel 124, the operating unit 215, the remote controller 217, etc. The control unit 200 also performs control to store various kinds of setting information, such as image quality setting information, programs, and vehicle information, into the memory 218.

Figure 9:
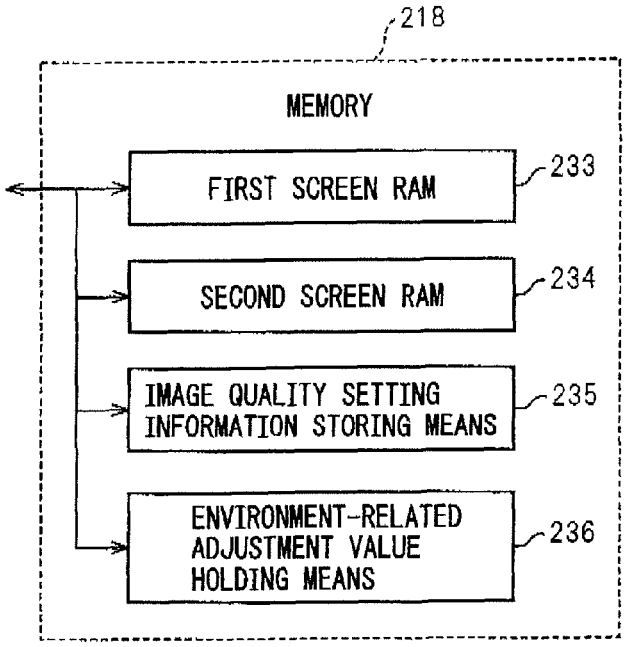
FIG. 9 is a block diagram schematically showing a memory 218.

FIG. 9 is a block diagram schematically showing the configuration of the memory 218. In the figure, reference numeral 233 indicates a first screen RAM, 234 a second screen RAM, 235 an image quality setting information storing means, and 236 an environment-related adjustment value holding means.

The memory 218 includes, for example, as shown in FIG. 9, the first and second screen RAMs 233 and 234 to which user-set image quality adjustment values for the first and second images, respectively, can be written. It also includes the image quality setting information storing means 235 in which a plurality of incremental image quality adjustment values for image quality adjustment are prestored as preset values that can be read out when adjusting the image quality of the first and second images. It further includes the environment-related adjustment value holding means 236 in which adjustment values for adjusting the image quality of the first and second images in accordance with the surrounding environment are held in order to adjust the image quality in response to changes in the surrounding environment such as changes in brightness outside the vehicle. The image quality setting information storing means 235 and the environment-related adjustment value holding means 236 are each constructed from an electrically alterable nonvolatile memory such as a flash memory or a battery-backed volatile memory.

Provisions may also be made so that an image, for example, from the rear monitoring camera 220 connected to the external sound/video input unit 219, is displayed on the display unit 7. Besides the rear monitoring camera 220, a video camera, a game machine, etc., may be connected to the external sound/video input unit 219.

The control unit 200 can perform control to change the settings for sound localization, etc. based on the information detected by the brightness detecting means 221 (for example, a vehicle light switch or light sensor) or the occupant detecting means 222 (for example, a pressure sensor mounted in the driver seat or the passenger seat).

The rear display unit 223 is a display unit for the rear seat, and can display the same images as those being displayed on the display unit 7 or either the driver-side image or the passenger-side image, whichever is selected, or an image from some other image source than the driver-side image source or the passenger-side image source.

The control unit 200 also performs control to produce a toll display based on the tolls detected by the onboard ETC unit 224. Further, the control unit 200 controls the communication unit 225 for connecting to a mobile phone or the like via a wireless link; here, control may be performed to display information related to the communication.

FIG. 10 is a diagram showing an example of how the various sound signal output devices are arranged inside a vehicle 20 equipped with the sound field reproduction system according to the present invention.

The vehicle 20 contains a passenger seat 12, a driver seat 13, a rear seat 17, a passenger seat headrest 21, a driver seat headrest 22, a left rear seat headrest 23, and a right rear seat headrest 24. The passenger seat 12 is equipped with front-seat vibrating devices 30 to 32 and first and second array speakers 40 and 41 which are narrow-directional speakers. Likewise, the driver seat 13 is equipped with front-seat vibrating devices 33 to 35 and third and fourth array speakers 42 and 43 which are narrow-directional speakers. On the other hand, the left rear seat headrest 23 is equipped with first and second speakers 50 and 51, and the right rear seat headrest 24 is equipped with third and fourth speakers 52 and 53. Further, the rear seat 17 is equipped with rear-seat vibrating devices 60 and 62 at positions below the left headrest 23 and rear-seat vibrating devices 63 to 65 at positions below the right headrest 24.

Figure 11:
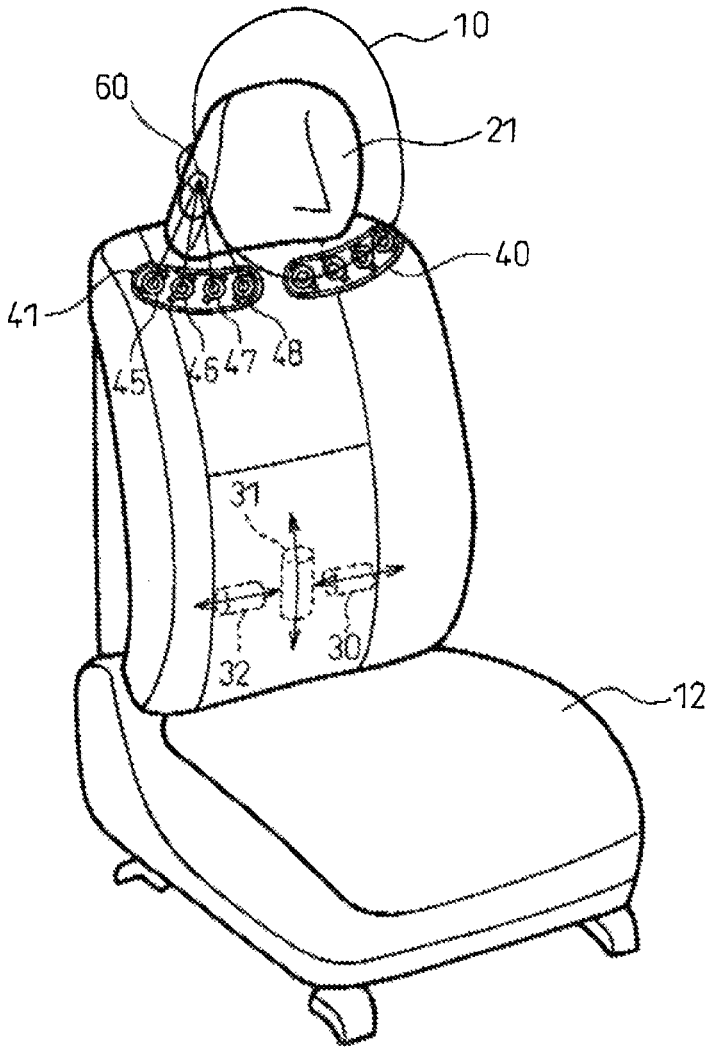
FIG. 11 is a diagram showing an example of how the sound signal output devices are mounted in a passenger seat.

FIG. 11 is a diagram showing an example of how the sound signal output devices are mounted in the passenger seat.

The front-seat vibrating devices 30 to 32 are mounted so as to be embedded in the polyurethane foam of the passenger seat 12. Preferably, the front-seat vibrating devices 30 to 32 are mounted by first forming recesses each slightly smaller than each vibrating device in the polyurethane foam of the passenger seat 12 and then pushing the vibrating devices into the respective recesses in the polyurethane foam, because the vibrations from the vibrating devices can then be transmitted effectively to the seat.

Each of the front-seat vibrating devices 30 to 35 has a cylindrical shape and contains a vibrating element that vibrates in directions parallel to the longitudinal direction of the vibrating device. The intensity of the vibration of the vibrating element varies in accordance with the sound signal input to the corresponding one of the vibrating devices 30 to 35. Accordingly, when sound signals are applied to the vibrating devices 30 to 35, the vibrating devices 30 to 35 vibrate in accordance with the sound signals applied to them. As shown in FIG. 11, the vibrating devices 30 and 32 are mounted horizontally in the seatback of the passenger seat 12, while the vibrating device 31 is mounted vertically in the seatback of the passenger seat 12. When sound signals are applied to the vibrating devices, the vibrating devices vibrate in the directions of arrows shown in FIG. 11. The number of vibrating devices mounted in the passenger seat 12 and the driver seat 13 is not limited to three for each seat, but only the center vibrating device 31 or 34 may be mounted, or more than three vibrating devices may be mounted in each seat.

The first and second array speakers 40 and 41 are mounted in the shoulders of the passenger seat 12. The first and second array speakers 40 and 41 each comprise four speaker units. As shown, the four speaker units 45 to 48 of the second array speaker 41 are arranged in an arc-like shape so that all the speaker units are located at the same distance from the right ear of the occupant 10 of the passenger seat 12. Though not shown here, the four speaker units of the first array speaker 40 are also arranged so that all the speaker units are located at the same distance from the left ear of the occupant 10 of the passenger seat 12. With this arrangement, the sound output from the first array speaker 40 localizes near the left ear of the passenger seat occupant 10, while the sound output from the second array speaker 41 localizes near the right ear of the passenger seat occupant 10. Here, the number of speaker units in the array speaker need not necessarily be limited to four, nor need the speaker units necessarily be arranged in an arc-like shape so that all the speaker units are located at the same distance from the right ear of the occupant 10 of the passenger seat 12. In FIG. 11, the description has been given for the passenger seat 12, but the same description also applies for the driver seat 13.

Figure 12:
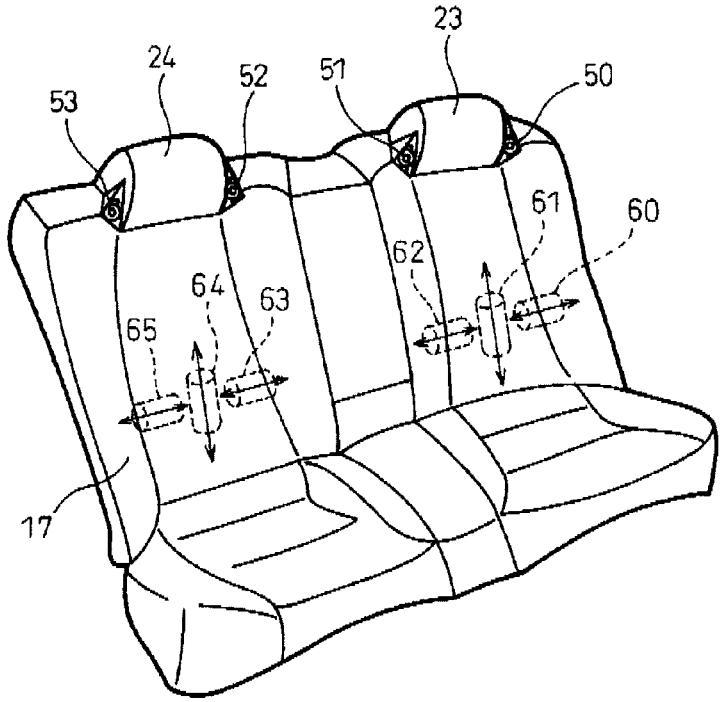
FIG. 12 is a diagram showing an example of how the sound signal output devices are mounted in a rear seat.
Figure 13:
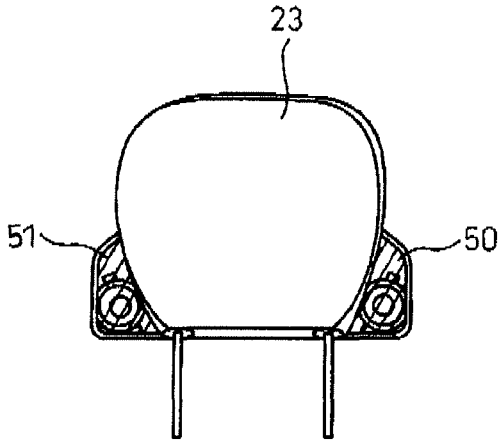
FIG. 13 is a diagram showing a left rear seat headrest 23 removed from the seat.

FIG. 12 is a diagram showing an example of how the sound signal output devices are mounted in the rear seat, and FIG. 13 is a diagram showing the left rear seat headrest 23 removed from the seat.

The first and second speakers 50 and 51 are mounted on the left and right sides of the left headrest 23 of the rear seat 17, and the third and fourth speakers 52 and 53 are mounted on the left and right sides of the right rear seat headrest 24. Here, the number of speakers for the rear seat is not limited to two for each headrest, but one or more than two speakers may be mounted for each headrest. In the illustrated example, the rear seat is shown as having two headrests, but alternatively, the rear seat may have three headrests. The speakers 50 to 53 mounted in the rear seat are conventional cone speakers which do no have high directivity. If speakers having high directivity were mounted in the rear seat, the amount of sound leaking from the rear seat area into the front seat area would increase.

The vibrating devices 60 to 62 are mounted so as to be embedded in the polyurethane foam of the rear seat 17 at positions below the left headrest 23, while the vibrating devices 63 to 65 are mounted so as to be embedded in the polyurethane foam of the rear seat 17 at positions below the right headrest 24. The configuration and arrangement of the rear-seat vibrating devices 60 to 65 are the same as those of the earlier described passenger-seat vibrating devices 30 to 32. The number of vibrating devices mounted in the rear seat is not limited to three for each headrest, but only the center vibrating devices 61 and 64 may be mounted, or more than three vibrating devices may be mounted for each headrest.

Figure 14:
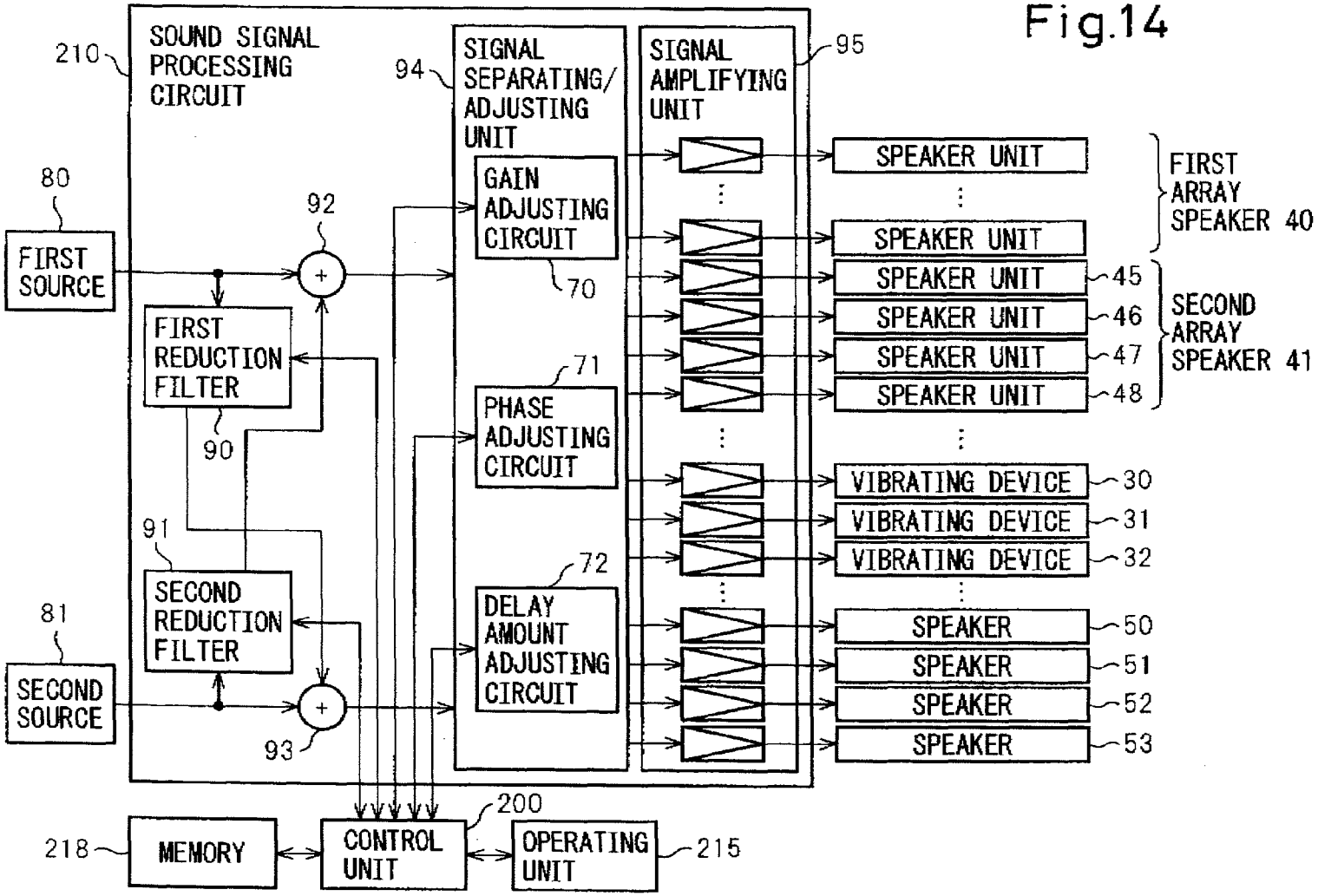
FIG. 14 is a diagram schematically showing the configuration of the sound field reproduction system according to the present invention.

FIG. 14 is a diagram schematically showing the configuration of the sound field reproduction system according to the present invention.

The configuration of the components related to the sound field reproduction in the entire system configuration shown in FIG. 6 is illustrated in FIG. 14 along with the details of the sound signal processing circuit and the sound signal output devices connected to it.

The sound signal processing circuit 210 comprises a first reduction filter 90, a second reduction filter 91, a first combiner 92, a second combiner 93, a signal separating/adjusting unit 94, and a signal amplifying unit 95. The first reduction filter 90, the second reduction filter 91, the first combiner 92, and the second combiner 93 together function as a unit for creating a first sound signal and a second sound signal from a first source 80 and/or a second source 81.

In FIG. 14, the first source 80 corresponds to any one source selected from among the CD/MD playback unit 201, the radio receiver unit 202, the TV receiver unit 203, the DVD playback unit 204, the HD playback unit 205, and the navigation unit 206 shown in FIG. 6. Likewise, the second source 81 corresponds to any one source selected from among the CD/MD playback unit 201, the radio receiver unit 202, the TV receiver unit 203, the DVD playback unit 204, the HD playback unit 205, and the navigation unit 206 shown in FIG. 6, but a different one from the one selected as the first source 80.

The first reduction filter 90 extracts a mid-frequency range signal (300 Hz to 3 kHz) from the sound signal output from the first source 80, and outputs a 180-degree out-of-phase sound signal which is fed as a first sound-leakage reducing sound signal to the second combiner 93. Likewise, the second reduction filter 91 extracts a mid-frequency range signal (300 Hz to 3 kHz) from the sound signal output from the second source 81, and outputs a 180-degree out-of-phase sound signal which is fed as a second sound-leakage reducing sound signal to the first combiner 91. Here, the first and second reduction filters 90 and 91 are controlled by the control unit 200.

The first combiner 92 combines the sound signal from the first source 80 with the second sound-leakage reducing sound signal fed from the second reduction filter 91, and outputs the thus combined signal to the signal separating/adjusting unit 94. Likewise, the second combiner 93 combines the sound signal from the second source 81 with the first sound-leakage reducing sound signal fed from the first reduction filter 90, and outputs the thus combined signal to the signal separating/adjusting unit 94.

The signal separating/adjusting unit 94 separates the combined signal from each of the first and second combiner 92 and 93 into a low-frequency range signal and a mid-to-high-frequency range signal, adjusts the thus separated signals, performs processing for distributing the signals among the various sound signal output devices, and outputs the signals to the respective sound signal output devices via the signal amplifying unit 95 which contains a plurality of amplifiers one for each sound signal output device.

The signal separating/adjusting unit 94 comprises a gain adjusting circuit 70 for performing processing for gain adjustment, a phase adjusting circuit 71 for performing processing for phase adjustment, and a delay amount adjusting circuit for performing processing for delay adjustment, and is configured so that the sound to be output from each of the speaker units of the first to fourth array speakers 40 to 43 can be adjusted according to the preference of each individual user. The adjustment of the sound to be output from each of the speaker units of the first to fourth array speakers 40 to 43 is accomplished by the control unit 200 controlling the gain adjusting circuit 70, the phase adjusting circuit 71, or the delay amount adjusting circuit 72. When adjusting the sound to be output from each of the speaker units of the first to fourth array speakers 40 to 43, the user selects a desired setting from a plurality of predetermined settings by operating the touch panel 124, the operating unit 215, or the remote controller 217. Here, it is assumed that control information related to the plurality of settings is prestored in the memory 218.

The sound field reproduction system according to the present invention has: a first mode in which the sound signal from the first source 80 is output to all the sound signal output devices; a second mode in which the sound signal from the first source 80 is output to the front-seat sound signal output devices (vibrating devices 30 to 35 and first to fourth array speakers 40 to 43), while the sound signal from the second source 81 is output to the rear-seat sound signal output devices (first to fourth speakers 50 to 53 and vibrating devices 60 to 65); and a third mode in which the sound signal from the first source 80 is output to the sound signal output devices (vibrating devices 30 to 32 and first and second array speakers 40 and 41) mounted in the passenger seat 12, while the sound signal from the second source 81 is output to the sound signal output devices (vibrating devices 33 to 35 and third to fourth array speakers 42 and 43) mounted in the driver seat 13. Switching between the three modes is performed by the control unit 200 controlling the sound signal processing circuit 210 based on the operation that the user performs from the touch panel 124, the operating unit 215, or the remote controller 217. Here, it is assumed that control information related to the respective modes is prestored in the memory 218.

The sound signal processing circuit 210 outputs the thus processed output sound signals to the front-seat vibrating devices 30 to 35, the speaker units of the first to fourth array speakers 40 to 43, the first to fourth speakers 50 to 53, and the rear-seat vibrating devices 60 to 65 in accordance with the selected mode and setting. The three modes and the plurality of settings will be described in detail later.

Figures 15A, 15B, 15C:
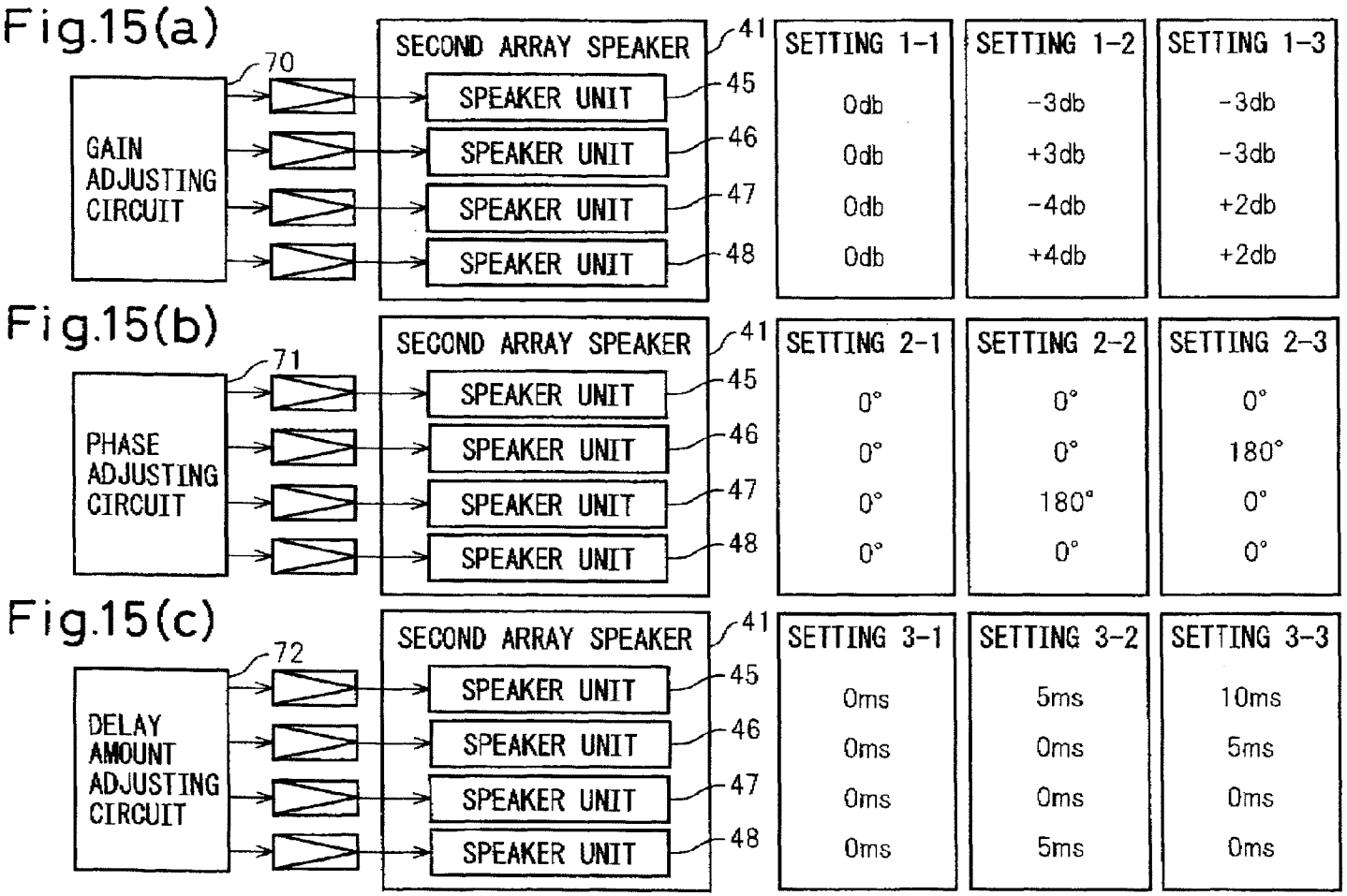
FIG. 15(*a*) is a diagram showing examples of settings for gain adjustment, FIG. 15(*b*) is a diagram showing examples of settings for phase adjustment, and FIG. 15(*c*) is a diagram showing examples of settings for delay amount adjustment.

FIG. 15 is a diagram showing examples of settings used to adjust the output sounds of the speaker units of each array speaker. FIG. 15(*a*) shows the settings for gain adjustment, FIG. 15(*b*) shows the settings for phase adjustment, and FIG. 15(*c*) shows the settings for delay amount adjustment. FIG. 15 shows the settings for the second array speaker 41, but the same settings are also applicable to the other array speakers. It will also be noted that the settings shown in FIG. 15 are only examples and not restrictive, and other settings may be used.

As shown in FIG. 15(*a*), the gain adjustment is performed in the gain adjusting circuit 70 by adjusting the gain of the signal output to each speaker unit in accordance with a predetermined set value when distributing the signal from the combiner 92 to the respective speaker units 45 to 48 of the second array speaker 41. For example, when the setting 1-1 is selected, the signal is not adjusted, but output as is to the respective speaker units. On the other hand, when the setting 1-2 is selected, for example, the gain of the signal output to the respective speaker units 45 to 48 is adjusted in accordance with the values shown in FIG. 15(*a*). Data concerning the settings 1-1 to 1-3 shown in FIG. 15(*a*) are prestored in the memory 218.

As shown in FIG. 15(*b*), the phase adjustment is performed in the phase adjusting circuit 71 by adjusting the phase of the signal output to each speaker unit in accordance with a predetermined set value when distributing the signal from the combiner 92 to the respective speaker units 45 to 48 of the second array speaker 41. For example, when the setting 2-1 is selected, the signal is not adjusted, but output as is to the respective speaker units. On the other hand, when the setting 2-2 is selected, for example, the phase of the signal output to the respective speaker units 45 to 48 is adjusted in accordance with the values shown in FIG. 15(*b*). In other words, only the signal to be output to the speaker unit 47 is adjusted by introducing a 180° phase shift. Data concerning the settings 2-1 to 2-3 shown in FIG. 15(*b*) are prestored in the memory 218.

As shown in FIG. 15(*c*), the delay amount adjustment is performed in the delay amount adjusting circuit 72 by adjusting the phase of the signal output to each speaker unit in accordance with a predetermined set value when distributing the signal from the combiner 92 to the respective speaker units 45 to 48 of the second array speaker 41. For example, when the setting 3-1 is selected, the signal is not adjusted, but output as is to the respective speaker units. On the other hand, when the setting 3-2 is selected, for example, the phase of the output signal to the respective speaker units 45 to 48 is adjusted in accordance with the values shown in FIG. 15(*c*). That is, the signal to be output to the speaker units 45 and 48 is adjusted by introducing a delay of 5 ms. Data concerning the settings 3-1 to 3-3 shown in FIG. 15(*c*) are prestored in the memory 218.

The reason that the plurality of settings are provided for each of the plurality of adjustments, as shown in FIGS. 15(*a*) to (*c*), is that the output sound from each array speaker may not correctly localize near the ear of the occupant because the position of the ear varies depending on the height and other physical features of the occupant, the driving or seating position, etc. Therefore, according to the present invention, the occupant can select the best setting for listening by trying various settings. FIG. 15 has shown the settings for the case where only one of the gain, phase, and delay amount adjustments is made, but the settings may be provided for a combination of these adjustments. Further, the sound signal processing circuit 210 need not necessarily have all of the gain adjusting circuit 70, the phase adjusting circuit 71, and the delay amount adjusting circuit 72.

Next, the various modes of the sound field reproduction system according to the present invention will be described.

(First Mode)

In the first mode, the sound signal from the first source 80 is output to all the sound signal output devices. In other words, the sound from the same source, i.e., the first source 80, is reproduced inside the vehicle 20. This corresponds, for example, to the case where all the occupants in the vehicle 20 listen to the music played back from the CD/MD playback unit 201. In this mode, the sound signal processing circuit 210 delivers the sound signal from the selected source to all the sound signal output devices.

In this case, the control unit 200 performs control to stop the operation of the first and second reduction filters 90 and 91 so that only the sound signal from the first source 80 (for example, the CD/MD playback unit 201) is input directly to the signal separating/adjusting unit 64.

(Second Mode)

In the second mode, the sound signal from the first source 80 is output only to the front-seat sound signal output devices (vibrating devices 30 to 35 and first to fourth array speakers 40 to 43), and the sound signal from the second source 81 is output only to the rear-seat sound signal output devices (first to fourth speakers 50 to 53 and rear-seat vibrating devices 60 to 65). That is, the sound from the first source 80 is reproduced in the front seat area of the vehicle 20, while the sound from the second source 81 is reproduced in the rear seat area. This corresponds, for example, to the case where the occupants of the passenger seat 12 and driver seat 13 listen to sound reproduced from the sound signal output from the navigation unit 206, while the rear seat occupants listen to the music played back from the CD/MD playback unit 201.

Figure 16A:
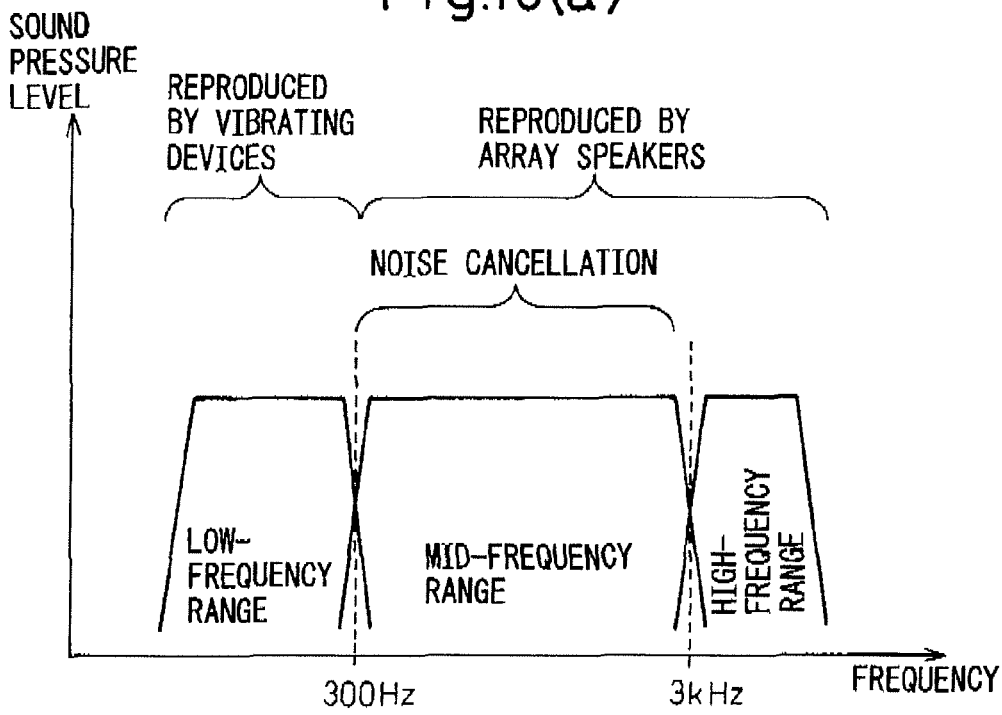
FIG. 16(*a*) is a diagram showing a signal output to the front-seat sound signal output devices in the second mode, and FIG. 16(*b*) is a diagram showing a signal output to the rear-seat sound signal output devices in the second mode.
Figure 16B:
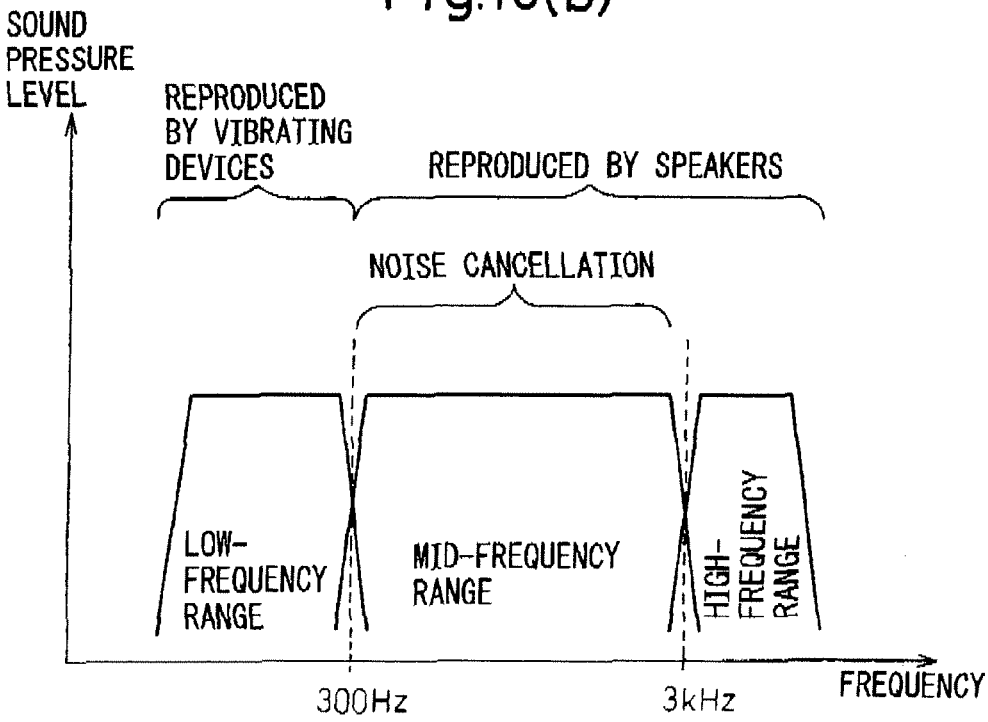

FIG. 16 is a diagram showing an example of how the signal is output to the respective sound signal output devices in the second mode. FIG. 16(*a*) shows the signal output to the front-seat sound signal output devices, and FIG. 16(*b*) shows the signal output to the rear-seat sound signal output devices.

In the second mode, the sound signal from the first source 80 is reproduced at the front seats as shown in FIG. 16(*a*); that is, the sound signal in the low-frequency range (lower than 300 Hz) is reproduced by the vibrating devices 30 to 35, while the sound signal in the mid-frequency range (300 Hz to 3 kHz) and high-frequency range (higher than 3 kHz) is reproduced by the first to fourth array speakers 40 to 43.

Here, control is performed so that the second sound-leakage reducing sound signal created from the mid-frequency component (300 Hz to 3 kHz) of the sound signal output from the second source 81 is superimposed on the mid-frequency range sound signal (300 Hz to 3 kHz) to be reproduced by the first to fourth array speakers 40 to 43. To accomplish such noise cancellation, the second reduction filter 91 extracts the mid-frequency component from the sound signal output from the second source 81, and the second sound-leakage reducing sound signal created by inverting the phase of the extracted signal is superimposed by the first combiner 92 onto the sound signal output from the first source 80. When the second sound-leakage reducing sound signal created from the sound signal output from the second source 81 to be reproduced at the rear seat is superimposed on the sound signal from the first source 80 to be reproduced at the front seats, if the sound being reproduced in the rear seat area leaks into the front seat area, the sounds will cancel each other, achieving the effect of making the sound being reproduced in the rear seat area not easily audible to the occupants of the front seats. The processing for extracting the low-frequency range sound signal from the sound signal input from the first combiner 92 and outputting it to the vibrating devices and the processing for outputting the mid-to-high frequency range sound signal to the array speakers are performed in the signal separating/adjusting unit 94.

In the second mode, the sound signal from the second source 81 is reproduced at the rear seat as shown in FIG. 16(*b*); i.e., the sound signal in the low-frequency range (for example, lower than 300 Hz) is reproduced by the rear-seat vibrating devices 60 to 65, while the sound signal in the mid-frequency range (for example, 300 Hz to 3 kHz) and high-frequency range (for example, higher than 3 kHz) is reproduced by the first to fourth speakers 50 to 53. In the second mode, the sound signal in the entire frequency range may be reproduced at the rear seat by the first to fourth speakers 50 to 53, eliminating the need for the rear-seat vibrating devices 60 to 65.

Here, control is performed so that the signal 180-degree out of phase with the mid-frequency range signal (for example, 300 Hz to 3 kHz) contained in the sound signal output from the first source 80 is superimposed on the mid-frequency range sound signal (for example, 300 Hz to 3 kHz) to be reproduced by the first to fourth speakers 50 to 53. To accomplish such noise cancellation, the first reduction filter 90 extracts the mid-frequency component from the sound signal output from the first source 80, and the 180-degree out-of-phase signal created by inverting the phase of the extracted signal is superimposed by the second combiner 93 onto the sound signal output from the second source 81. When the 180-degree out-of-phase signal created from the sound signal output from the first source 80 to be reproduced at the front seats is superimposed on the sound signal from the second source 81 to be reproduced at the rear seat, if the sound being reproduced in the front seat area leaks into the rear seat area, the sounds will cancel each other, achieving the effect of making the sound being reproduced in the front seat area not easily audible to the occupants of the rear seat. The processing for extracting the low-frequency range sound signal from the sound signal input from the second combiner 93 and outputting it to the vibrating devices and the processing for outputting the mid-to-high frequency range sound signal to the speakers are performed in the signal separating/adjusting unit 94.

Figure 17:
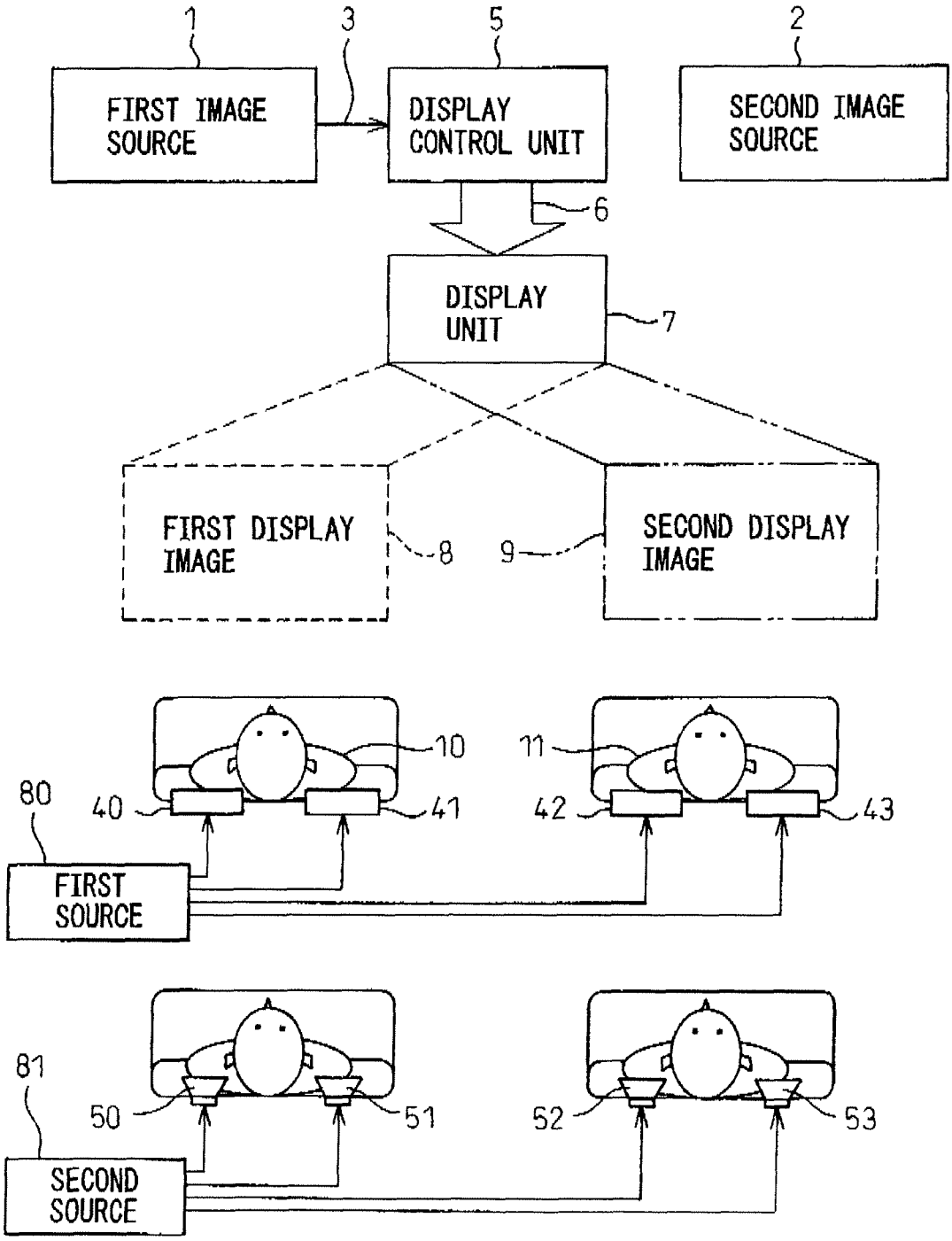
FIG. 17 is a diagram showing the condition when the system is in the second mode.

FIG. 17 is a diagram showing the condition when the system is in the second mode.

As shown in FIG. 17, in the second mode, the occupants of the passenger seat 12 and driver seat 13 view the first display image output from the first image source 1, while listening to the sound from the first source 80 corresponding to the first image source 1, and the occupants of the rear seat 17 listen to the sound output from the second source 81. In this way, in the second mode, the occupants of the front and rear seats of the vehicle can respectively listen to different sound sources and/or music sources in a good condition.

(Third Mode)

In the third mode, the sound signal from the first source 80 is output to the sound signal output devices (vibrating devices 30 to 32 and first and second array speakers 40 and 41) mounted in the passenger seat 12, and the sound signal from the second source 81 is output to the sound signal output devices (vibrating devices 33 to 35 and third to fourth array speakers 42 and 43) mounted in the driver seat 13. In other words, the sound from the first source 80 is reproduced at the passenger seat 12, while the sound from the second source 81 is reproduced at the driver seat 13. This corresponds, for example, to the case where the first display image 8 from the DVD playback unit 204 and the second display image 9 from the navigation unit 206 are displayed simultaneously on the display unit 7 that functions as a multi-view display unit, allowing the occupant of the passenger seat 12 to listen to the sound from the DVD playback unit 204 and the occupant of the driver seat 13 to listen to the sound from the navigation unit 206.

In the third mode, the sound signal from the first source 80 is reproduced at the passenger seat 12 as shown in FIG. 16(*a*); i.e., the sound signal in the low-frequency range (lower than 300 Hz) is reproduced by the vibrating devices 30 to 32, while the sound signal in the mid-frequency range (300 Hz to 3 kHz) and high-frequency range (higher than 3 kHz) is reproduced by the first and second array speakers 40 and 41.

Here, control is performed so that the second sound-leakage reducing sound signal created from the mid-frequency component (300 Hz to 3 kHz) of the sound signal output from the second source 81 is superimposed on the mid-frequency range sound signal (300 Hz to 3 kHz) to be reproduced by the first and second array speakers 40 and 42. To accomplish such noise cancellation, the second reduction filter 91 extracts the mid-frequency component from the sound signal output from the second source 81, and the second sound-leakage reducing sound signal created by inverting the phase of the extracted signal is superimposed by the first combiner 92 onto the sound signal output from the first source 80. When the second sound-leakage reducing sound signal created from the sound signal output from the second source 81 to be reproduced at the driver seat 13 is superimposed on the sound signal from the first source 80 to be reproduced at the passenger seat 12, if the sound being reproduced in the area of the driver seat 13 leaks into the area of the passenger seat 12, the sounds will cancel each other, achieving the effect of making the sound being reproduced in the area of the driver seat 13 not easily audible to the occupant of the passenger seat 12. The processing for extracting the low-frequency range sound signal from the sound signal input from the first combiner 92 and outputting it to the vibrating devices and the processing for outputting the mid-to-high frequency range sound signal to the array speakers are performed in the signal separating/adjusting unit 94.

Likewise, in the third mode, the sound signal from the second source 81 is reproduced at the driver seat 13 as shown in FIG. 16(*a*); i.e., the sound signal in the low-frequency range (lower than 300 Hz) is reproduced by the vibrating devices 33 to 35, while the sound signal in the mid-frequency range (300 Hz to 3 kHz) and high-frequency range (higher than 3 kHz) is reproduced by the third and fourth array speakers 42 and 43.

Here, control is performed so that the first sound-leakage reducing sound signal created from the mid-frequency component (300 Hz to 3 kHz) of the sound signal output from the first source 80 is superimposed on the mid-frequency range sound signal (300 Hz to 3 kHz) to be reproduced by the third and fourth array speakers 42 and 43. To accomplish such noise cancellation, the first reduction filter 90 extracts the mid-frequency component from the sound signal output from the first source 80, and the first sound-leakage reducing sound signal created by inverting the phase of the extracted signal is superimposed by the second combiner 93 onto the sound signal output from the second source 81. When the first sound-leakage reducing sound signal created from the sound signal output from the first source 80 to be reproduced at the passenger seat 12 is superimposed on the sound signal from the second source 81 to be reproduced at the driver seat 13, if the sound being reproduced in the area of the passenger seat 12 leaks into the area of the driver seat 13, the sounds will cancel each other, achieving the effect of making the sound being reproduced in the area of the passenger seat 12 not easily audible to the occupant of the driver seat 13. The processing for extracting the low-frequency range sound signal from the sound signal input from the second combiner 93 and outputting it to the vibrating devices and the processing for outputting the mid-to-high frequency range sound signal to the array speakers are performed in the signal separating/adjusting unit 94.

In this way, in the third mode, the sound and/or music corresponding to the first display image 8 and the second display image 9 simultaneously displayed on the display unit 7 can be enjoyed in a good condition at the passenger seat 12 and the driver seat 13, respectively.

In the above description, the frequency range lower than 300 Hz has been classified as the low-frequency range, the frequency range of 300 Hz to 3 kHz as the mid-frequency range, and the frequency range higher than 3 kHz as the high-frequency range, but the classification of the frequency ranges is not limited to the above example; for example, the frequency range of 100 to 500 Hz may be taken as the low-frequency range, the frequency range of 1 kHz to 3 kHz as the high-frequency range, and the frequency range between the low and high frequency ranges as the mid-frequency range.

While the sound field reproduction system according to the present invention has been described above as having three modes, it will be recognized that the sound field reproduction system need not necessarily have all the three modes. Further, the narrow-directional speakers need not necessarily be mounted in the seats, but may be mounted near the seats.

In the above description, the term narrow-directional speaker refers to the speaker whose characteristic along the center axis of the speaker greatly differs from the characteristic along an axis tilted by an angle θ from the center axis of the speaker. For example, a speaker whose average sound pressure along the center axis of the speaker in the frequency range higher than 3 kHz is 13 dB or more greater than that along an axis tilted by 30 degrees from the center axis of the speaker can be used as the narrow-directional speaker in the present embodiment.

What is claimed is:

1. A sound field reproduction system comprising:

a control unit for creating a first sound signal and a second sound signal from one or a plurality of sources;

a narrow-directional speaker mounted in or near a front seat of a vehicle;

a speaker mounted in or near a rear seat of said vehicle; and a signal processing unit for driving said narrow-directional speaker based on said first sound signal that has been processed according to a frequency range, and for driving said speaker based on said second sound signal, wherein said signal processing unit is configured to create a first sound-leakage reducing sound signal from said first sound signal, to combine said first sound-leakage reducing sound signal with said second sound signal, to create a second sound-leakage reducing sound signal from said second sound signal, and to combine said second sound-leakage reducing sound signal with said first sound signal.

2. The sound field reproduction system according to claim 1, further comprising a front-seat vibrating device mounted in the front seat of said vehicle.

3. The sound field reproduction system according to claim 2, wherein said signal processing unit is configured to output:

a low-frequency range signal contained in said first sound signal to said front-seat vibrating device, a mid-to-high frequency range signal contained in said first sound signal to said narrow-directional speaker, a second sound-leakage reducing signal created from a mid-frequency range signal contained in said second sound signal to said narrow-directional speaker, said second sound signal to said speaker, and a first sound-leakage reducing signal created from a mid-frequency range signal contained in said first sound signal to said speaker.

4. The sound field reproduction system according to claim 1, further comprising a rear-seat vibrating device mounted in the rear seat of said vehicle.

5. The sound field reproduction system according to claim 4, wherein said signal processing unit is configured to output:

a low-frequency range signal contained in said first sound signal to said front-seat vibrating device, a mid-to-high frequency range signal contained in said first sound signal to said narrow-directional speaker, a second sound-leakage reducing signal created from a mid-frequency range signal contained in said second sound signal to said narrow-directional speaker, a low-frequency range signal contained in said second sound signal to said rear-seat vibrating device, a mid-to-high frequency range signal contained in said second sound signal to said speaker, and a first sound-leakage reducing signal created from a mid-frequency range signal contained in said first sound signal to said speaker.

6. The sound field reproduction system according to claim 1, wherein said narrow-directional speaker is an array speaker having a plurality of speaker units.

7. The sound field reproduction system according to claim 6, wherein said plurality of speaker units are arranged at equal distances from a listener.

8. The sound field reproduction system according to claim 7, further comprising an adjusting circuit for adjusting sound signals to be output to said plurality of speaker units.

9. The sound field reproduction system according to claim 8, further comprising a storage means for storing a plurality of settings defining a parameter for adjusting the sound signals to be output to said plurality of speaker units, and a setting selecting means for selecting one of said plurality of settings.

10. The sound field reproduction system according to claim 8, wherein said adjusting circuit is a gain adjusting circuit for adjusting a gain of at least one of the plurality of sound signals to be output to said plurality of speaker units.

11. The sound field reproduction system according to claim 8, wherein said adjusting circuit is a phase adjusting circuit for adjusting a phase of at least one of the plurality of sound signals to be output to said plurality of speaker units.

12. The sound field reproduction system according to claim 8, wherein said adjusting circuit is a delay amount adjusting circuit for adjusting an amount of delay of at least one of the plurality of sound signals to be output to said plurality of speaker units.

13. A sound field reproduction system comprising:

a control unit for creating a first sound signal and a second sound signal from one or a plurality of sources;

a first narrow-directional speaker mounted on a passenger side of a vehicle;

a second narrow-directional speaker mounted on a driver side of said vehicle; and a signal processing unit for driving said first narrow-directional speaker based on said first sound signal that has been processed according to frequency range, and for driving said second narrow-directional speaker based on said second sound signal has been processed according to a frequency range, wherein said signal processing unit is configured to create a first sound-leakage reducing sound signal from said first sound signal, to combine said first sound-leakage reducing sound signal with said second sound signal, to create a second sound-leakage reducing sound signal from said second sound signal, and to combine said second sound-leakage reducing sound signal with said first sound signal.

14. The sound field reproduction system according to claim 13, further comprising a first vibrating device mounted on the passenger side of said vehicle and a second vibrating device mounted on the driver side of said vehicle.

15. The sound field reproduction system according to claim 14, wherein said signal processing unit is configured to output:

a low-frequency range signal contained in said first sound signal to said first vibrating device, a mid-to-high frequency range signal contained in said first sound signal to said first narrow-directional speaker, a second sound-leakage reducing signal created from a mid-frequency range signal contained in said second sound signal to said first narrow-directional speaker, a low-frequency range signal contained in said second sound signal to said second vibrating device, a mid-to-high frequency range signal contained in said second sound signal to said second narrow-directional speaker, and a first sound-leakage reducing signal created from a mid-frequency range signal contained in said first sound signal to said second narrow-directional speaker.

16. The sound field reproduction system according to claim 13, wherein each of said first and second narrow-directional speaker is an array speaker having a plurality of speaker units.

17. The sound field reproduction system according to claim 16, wherein said plurality of speaker units are arranged at equal distances from a listener.

18. The sound field reproduction system according to claim 17, further comprising an adjusting circuit for adjusting sound signals to be output to said plurality of speaker units.

19. The sound field reproduction system according to claim 18, further comprising a storage means for storing a plurality of settings defining a parameter for adjusting the sound signals to be output to said plurality of speaker units, and a setting selecting means for selecting one of said plurality of settings.

20. The sound field reproduction system according to claim 18, wherein said adjusting circuit is a gain adjusting circuit for adjusting a gain of at least one of the plurality of sound signals to be output to said plurality of speaker units.

21. The sound field reproduction system according to claim 18, wherein said adjusting circuit is a phase adjusting circuit for adjusting the phase of at least one of the plurality of sound signals to be output to said plurality of speaker units.

22. The sound field reproduction system according to claim 18, wherein said adjusting circuit is a delay amount adjusting circuit for adjusting an amount of delay of at least one of the plurality of sound signals to be output to said plurality of speaker units.

* * * * *